US006403929B2

(12) United States Patent
Brindani

(10) Patent No.: US 6,403,929 B2
(45) Date of Patent: Jun. 11, 2002

(54) METHOD AND DEVICE FOR SENSING OVERHEATING OF A CONTAINER POSITIONED ON A GLASS CERAMIC COOKING HOB DURING THE PREPARATION OF A FOOD

(75) Inventor: Franco Brindani, Casciago (IT)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/735,143

(22) Filed: Dec. 12, 2000

(30) Foreign Application Priority Data

Dec. 16, 1999 (IT) ..... MI99A2607

(51) Int. Cl.[7] ..... H05B 3/68; H05B 1/02
(52) U.S. Cl. ..... 219/448.11; 219/490; 219/494
(58) Field of Search ..... 219/446.1, 447.1, 219/448, 11, 448.12, 448.13, 448.14, 448.16, 448.17, 448.18, 448.19, 460.1, 461.1, 490, 492, 494, 497, 509, 510, 518

(56) References Cited

U.S. PATENT DOCUMENTS 4,740,664 A * 4/1988 Payne et al. ..... 219/448.12
5,430,427 A * 7/1995 Newman et al. ..... 219/448.17
5,856,654 A * 1/1999 Frasnetti et al. ..... 219/448.12
5,900,174 A * 5/1999 Scott ..... 219/447.1
5,951,897 A * 9/1999 Wauer et al. ..... 219/448.11
6,246,034 B1 * 6/2001 Glaser et al. ..... 219/501

* cited by examiner

*Primary Examiner*—Sang Paik
(74) *Attorney, Agent, or Firm*—Joel M. Van Winkle; Robert O. Rice; Stephen Krefman

(57) ABSTRACT

A method for sensing overheating of a food container positioned on a glass ceramic cooking hob, for example during the preparation of a food contained in said container, electrical heating elements being provided for predefined regions of said hob. The method includes continuously measuring the variation in temperature of the region of the cooking hob during the activation of a corresponding heating element on which the container is positioned on the hob. The method further includes halting said activation when said temperature undergoes a sudden increase relative to a temperature value maintained substantially constant with time during activation of the heating element.

4 Claims, 2 Drawing Sheets

METHOD AND DEVICE FOR SENSING OVERHEATING OF A CONTAINER POSITIONED ON A GLASS CERAMIC COOKING HOB DURING THE PREPARATION OF A FOOD

BACKGROUND OF THE INVENTION

1. Field of the Invention

This invention relates to a method for sensing overheating of a food container in accordance with the introduction to the main claim. The invention also relates to a device for implementing the method.

2. Description of the Related Art

Various methods are known for controlling components of a glass ceramic cooking hob, such as the heating elements associated with it or the glass ceramic surface on which the food containers rest. For example, EP0886459 describes and claims a method and device for controlling the heating elements (ie their electrical supply and hence the heating power generated by them) of a cooking hob of the aforesaid type in order that the temperature of the glass ceramic surface does not exceed a predetermined safety value.

With the known solutions and methods, the heating elements are controlled on the basis of measurement of the temperature of the glass ceramic surface. Using this measurement (effected by usual sensors which directly or indirectly measure the temperature of the glass ceramic surface), a heating element control unit successively activates and deactivates the elements in order to maintain said glass ceramic surface temperature within safety limits. The manner in which this cycle of successive activations and deactivations (which lasts from the moment in which a user switches a heating element on until he switches it off) is implemented means that said surface reaches temperatures which differ considerably (by 30–40° C.) from the measured temperature. Consequently, even though the known methods enable the temperature of this surface to be maintained within safety limits, they do not allow the temperature to be instantly and precisely controlled at each moment of use of the cooking hob for food preparation.

It has been surprisingly found that the temperature of the glass ceramic surface is also related to any overheating of a food container positioned on it during food preparation. In particular, it has been found that the absence of liquid in a container positioned on a region of said surface corresponding to an active heating element results in a sudden and considerable increase in the surface temperature to well beyond the safety limit, with obvious problems and consequences for the mechanical stability and average life of the glass ceramic cooking hob. This sudden temperature increase has hence been found to arise on overheating of the container.

The known heating element control methods and devices operating on the basis of the temperature of the glass ceramic surface do not adequately detect container overheating or act sufficiently quickly on the heating elements, as they control these elements only by cyclic temperature measurement and act on these elements only at relatively lengthy time intervals corresponding to temperature limits relatively very far apart (for example 30–40° C.). If a container on the cooking hob were to undergo sudden overheating during one of these activation and deactivation cycles, known devices would sense this only with considerable time delay.

Moreover, although said devices are able to limit the temperature of the glass ceramic after a user has switched a heating element on, they are not able to automatically switch the heating element off if the temperature exceeds or remains above a predetermined limit.

SUMMARY OF THE INVENTION

An object of the invention is therefore to provide a method for measuring and interrupting the overheating of a food container if its contents are lacking or depleted, said method being reliable and resulting in a rapid solution to the said overheating problem, with prevention of any irremediable effect at least on the cooking hob.

A further object is to provide a device for implementing the aforesaid method which is of simple construction and reliable with time.

These and further objects which will be apparent to an expert of the art are attained by a method and device in accordance with the accompanying claims.

BRIEF DESCRIPTION OF THE DRAWINGS

The invention will be more apparent from the accompanying drawing, which is provided by way of non-limiting example and on which.

DESCRIPTION OF THE PREFERRED EMBODIMENT

Figure 1:
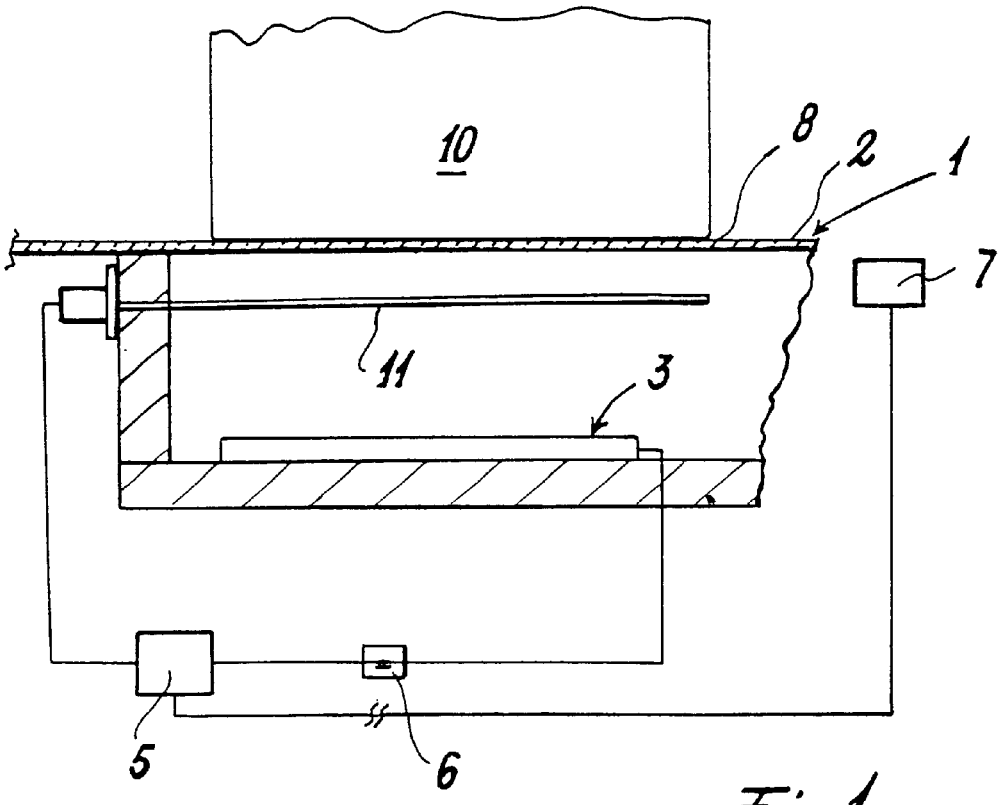
FIG. 1 is a schematic view of the device of the invention.

FIG. 1 schematically shows a cooking hob 1 with a glass ceramic surface 2 below which there is positioned at least one electrical heating element 3 (such as a halogen lamp, a resistance element etc.) powered by the usual electric mains (not shown). The heating element 3 is controlled by a unit 5, preferably a microprocessor, which controls the element 3 via an electrical circuit 6 of known type. In particular, the element 3 is controlled by usual known means for frequency-regulating the power fed to the element 3 (these defining a known circuit configuration of the cycle skipping type) which are present in the circuit 6.

The control unit for the element 3 is connected to a usual activation member for this element, for example a knob 7 located in a suitable position relative to the hob 1. By means of this knob, the user activates (or deactivates) the heating element to obtain consequent heating of a corresponding region 8 on the surface 2 of the hob 1. This region (or cooking region) 8 is arranged to receive a food container 10 of any known type.

In proximity to the surface 2, between this surface and the heating element 3, there is positioned a usual temperature sensor 11 for measuring the temperature of the surface 2. This sensor is connected to the unit 5 which, as described hereinafter, activates/deactivates the heating element 3 on the basis of the data obtained by said sensor, to prevent the container 10 from overheating should it be empty or should its contents have evaporated (in the case of a liquid) or be undergoing carbonization (in the case of a solid).

Figure 3:
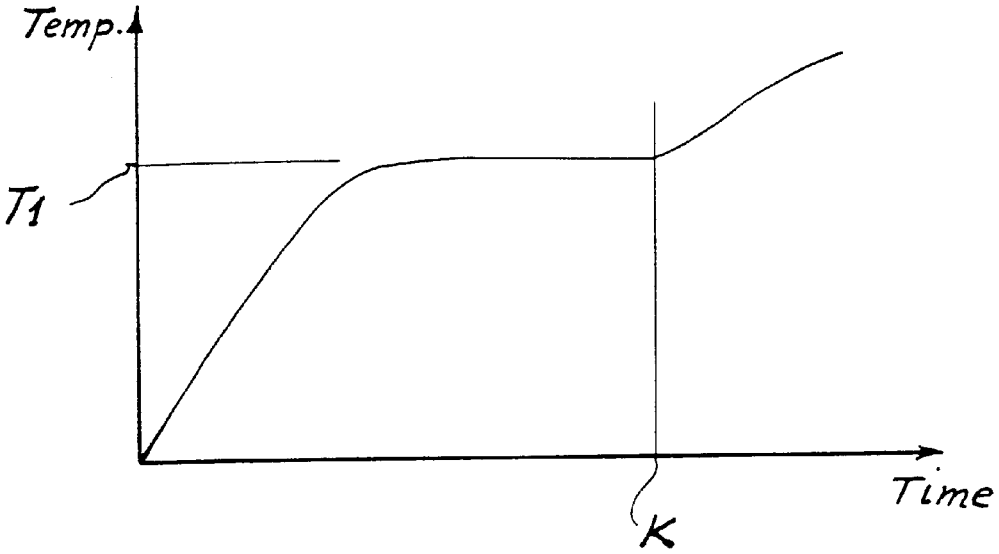
FIG. 3 is a time/temperature graph showing the variation in the temperature of a glass ceramic hob during food preparation, during which sudden overheating of the container occurs.

More particularly, by frequency-controlling the power fed to the heating element 3 and from the temperature data measured by the sensor 11, the unit 5 is able to "construct" a time/temperature curve such as that shown in FIG. 3. In other words, this unit controls power feed to the element 3 such that a succession of different-power levels enables the temperature of the surface 2 to be controlled with very close temperature variations (for example ±5° C.) in order to maintain it substantially constant. Consequently, by continuously monitoring the temperature of the hob 1, the unit 5 controls the temperature of the surface 2 with an accuracy such as to be able to precisely identify the temperature of the region 8 of the hob 1 at every moment of operation of the element 3. In this manner, an optimum temperature (T1) can be maintained for preparing the food contained in the container 10.

By means of this power control and the measurement provided by the sensor 11, the unit 5 is also able to sense if, such as at the moment K of FIG. 3, the temperature of the region 8 undergoes a sudden undesirable increase.

It has been surprisingly discovered that the temperature of the region 8 is related to the temperature of the container 10. Hence, if the container 10 overheats during food preparation (for the aforesaid reasons), this is indicated by a sudden unscheduled increase in the temperature of the region 8, also indicating for example that the liquid contained in it has completely evaporated. In other words, if at the moment K the temperature/time curve of the surface 2 shows a positive slope change, this indicates an increase in the temperature of the container 10 related to its overheating. In this case, the unit 5 acts on the electrical feed to the heating element 3 to interrupt it, and hence halt said overheating.

Figure 2:
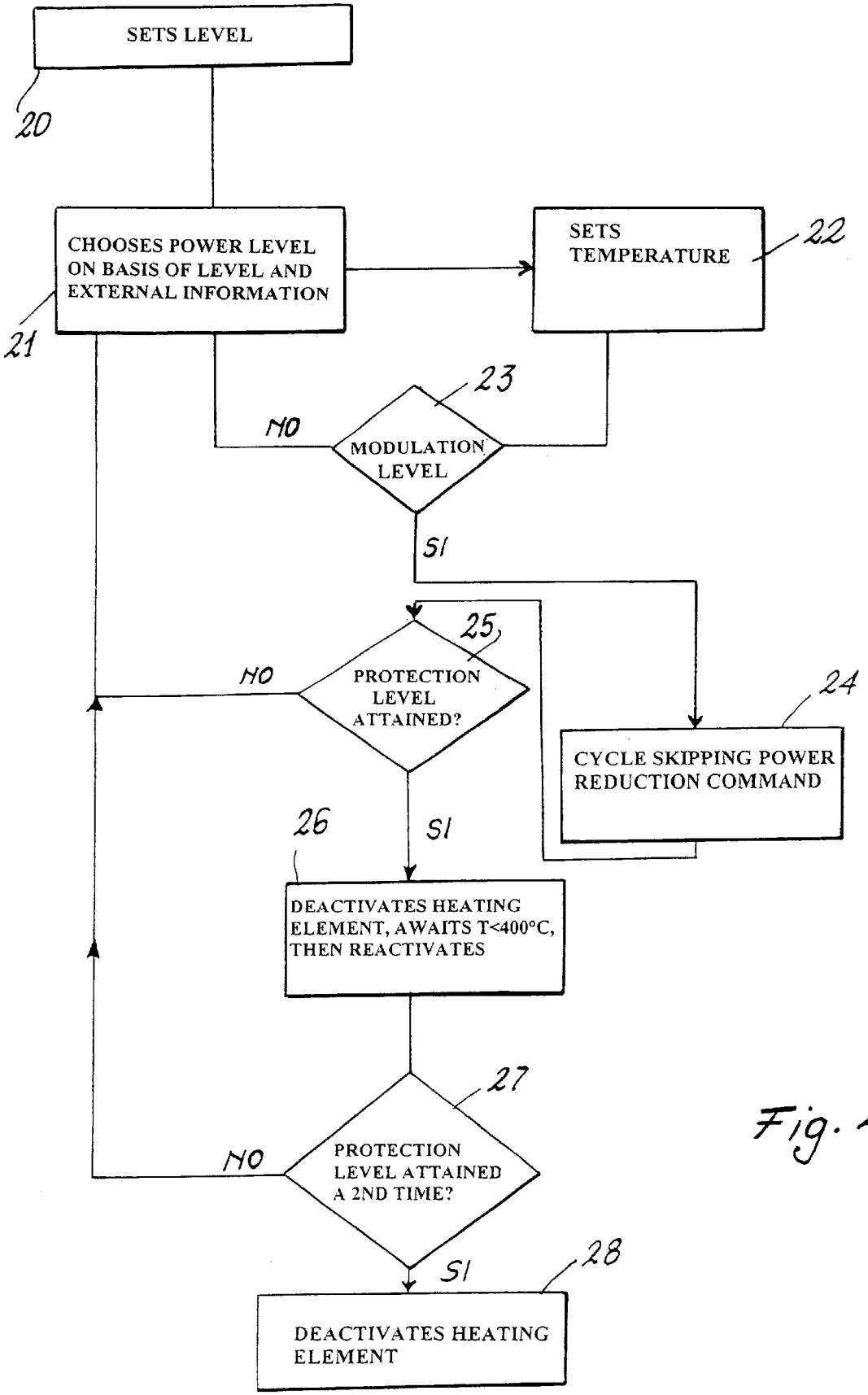
FIG. 2 is a flow diagram exemplifying the method of the invention.

The method of operation of the unit 5 is shown in FIG. 2. The block 20 of this diagram represents activation of a heating element 3 by the user and selection of the heating power level. Following this setting, the unit 5 chooses the feed power level to the element 3 (block 21) and selects the corresponding temperature level of the region 8 (relative to the element 3) of the hob 1 on which the container 10 is positioned (block 22). The unit 5 then evaluates whether the temperature reached by the region 8 is the correct one corresponding to the heating power level selected by the user. If incorrect, it effects a new temperature selection cycle, whereas if correct it initiates frequency control of the power fed to the element 3 (block 24) so as to maintain the set (cooking) temperature reached by the heating element. In this case it commences cycle skipping of this power feed by modifying the power in such a manner as to maintain the set temperature of the heating element region 8.

During use of the hob, ie during power feed to the heating element 3, the unit 5 continuously evaluates (block 25) whether the temperature curve (FIG. 3) presents a discontinuity, ie a sudden temperature rise in the region 8 of the heating element representative of overheating of the container 10. If there is not, the unit 5 continues to maintain the already attained power level of the element 3. If however there is a positive temperature rise (ie the aforesaid event occurs at point K of FIG. 3) and this continues to a first preset limit (for example 600° C.), the unit acts (block 26) on the power to the element 3 to deactivate it and maintain this element deactivated until the temperature of the hob region 8 falls to a second temperature limit, for example less than 400° C. These values (and in particular the first temperature limit) are chosen on the basis of the components of the cooking hob (burner and surface 2), such as to prevent damage to them.

The unit 5 acts to halt overheating of the container 10. Subsequently, after the temperature of the region 8 reaches the second temperature limit (lower than the first), the unit 5 reactivates power to the element 3 and maintains temperature control (blocks 23 and 24) of the hob region 8. If this again approaches the first limit and exceeds it even slightly, the unit 5 permanently deactivates the heating element (block 28) to prevent any further heating of the container 10. Otherwise, it maintains power to the heating element 3 until the user switches it off via the control member 7 (knob).

It should be noted that during the time in which the unit 5 maintains the element 3 deactivated after evaluation by the block 26, the user can always reactivate this element by operating the knob and again setting it to its activation position.

An acoustic and/or visual warning device can also be provided to display that power to the heating element has been interrupted.

By virtue of the invention and the surprising discovery that an unequivocal relationship exists between the temperature of the cooking hob and the temperature of a container positioned on it, any overheating thereof can be prevented, so protecting both the container and the cooking hob against damage which could compromise their reuse or intactness with time.

I claim:

1. A method for sensing overheating of a food container positioned on a glass ceramic cooking hob having electrical heating elements provided for predefined regions of said hob, said method comprising the steps of:

continuously measuring the variation in temperature of the region of the cooking hob during the activation of a corresponding heating element on which said container is positioned, wherein the temperature of the container is related to the temperature of the region on which the container lies; and halting said activation when said temperature undergoes a sudden increase relative to the substantially constant temperature value maintained with time during activation of the heating element associated with a state of overheating of said container wherein the halting step further comprises the step of:

stopping the electrical feed to the heating element when the temperature reached by that region of the cooking hob corresponding to said element attains a first predefined temperature limit, the stoppage being followed by a successive evaluation of the temperature of said region, restoring electrical feed to the heating element if the measured temperature of said region of the cooking hob falls to below a second predefined temperature limit, permanently halting electrical feed to the heating element if, following a further temperature evaluation, it is found that the temperature has risen for a second time above the first temperature limit.

2. A method as claimed in claim 1, wherein the first temperature limit is between 550 and 750° C., and is preferably 600° C.

3. A method as claimed in claim 1, wherein the second temperature limit, at which the heating element is reactivated, is between 350 and 450° C., and is preferably 400° C.

4. A method as claimed in claim 1, wherein the stoppage of the activation of the heating element following the second rise beyond the first temperature limit can be inhibited by re-zeroing an activation command for the element and restoring it by a usual activation control member operable by the user.

* * * * *